United States Patent [19]

Ciriacks

[11] Patent Number: 4,917,254

[45] Date of Patent: Apr. 17, 1990

[54] SANITARY DISPOSABLE CONTAINER

[76] Inventor: Brian L. Ciriacks, 1995 Hwy. 83 South, Hartford, Wis. 53027

[21] Appl. No.: 339,222

[22] Filed: Apr. 17, 1989

[51] Int. Cl.[4] ..... B65D 90/00; B65D 25/00

[52] U.S. Cl. ..... 220/1 T; 206/205; 206/222; 220/87; 220/346; 220/351; 239/57; 383/120

[58] Field of Search ..... 220/1 T, 87, 345, 346, 220/351; 383/2, 120, 104; 229/41 C, 41 R; 206/205, 222, 600; 239/36, 57, 34

[56] References Cited

U.S. PATENT DOCUMENTS

| | | | |
|---|---|---|---|
| D. 258,409 | 3/1981 | Nattrass | 220/1 T X |
| 705,672 | 7/1902 | Hughes | 220/1 T |
| 831,476 | 9/1906 | Ryan | 220/345 X |
| 1,221,808 | 4/1917 | Witte | 220/87 |
| 1,239,307 | 9/1917 | Schmid | 220/345 |
| 1,323,918 | 12/1919 | Seraphine | 220/87 |
| 1,409,387 | 3/1922 | Madigan | 220/87 |
| 1,622,853 | 3/1927 | Turnbull | 220/87 |
| 1,867,080 | 7/1932 | Kraft | 220/345 |
| 1,907,082 | 5/1933 | Meltzer | 383/120 X |
| 2,015,824 | 10/1935 | Troupeter | 220/87 |
| 2,112,465 | 3/1938 | Maish | 220/1 T X |
| 2,434,238 | 1/1948 | Wolfson | 220/87 |
| 2,562,248 | 7/1951 | Weed | 220/345 |
| 2,725,087 | 11/1955 | Potter | 206/600 X |
| 2,802,590 | 8/1957 | Tupper | 220/87 X |
| 2,952,379 | 9/1960 | Potter | 206/600 X |
| 3,227,374 | 1/1966 | Valentine | 239/57 X |
| 3,229,914 | 1/1966 | Seavy | 220/87 X |
| 3,291,373 | 12/1966 | Joyce | 383/120 |
| 3,393,825 | 7/1968 | Clauser | 220/87 |
| 3,399,818 | 9/1968 | Stegner | 220/462 |
| 3,454,177 | 7/1969 | Bloom | 206/222 |
| 3,495,762 | 2/1970 | Verbic | 383/2 X |
| 3,554,434 | 1/1971 | Anderson | 383/104 |
| 3,647,102 | 3/1972 | Cooley | 220/345 X |
| 3,669,347 | 6/1972 | Platz | 383/104 |
| 3,682,372 | 8/1972 | Rodley | 383/104 |
| 3,715,189 | 2/1973 | Nighohossian et al. | 206/222 X |
| 3,738,565 | 6/1973 | Ackley et al. | 383/104 |
| 3,743,172 | 7/1973 | Ackley et al. | 383/104 |
| 3,840,145 | 10/1974 | Almenza | 220/87 |
| 3,893,725 | 7/1975 | Coulter et al. | 220/1 T X |
| 3,964,684 | 6/1976 | Schimanski | 239/57 X |
| 4,103,777 | 8/1978 | Wiegner | 206/222 |
| 4,437,575 | 3/1984 | Hahn | 220/1 T |
| 4,491,959 | 1/1985 | Loefberg | 383/103 |
| 4,785,931 | 11/1988 | Weir et al. | 206/222 |
| 4,836,370 | 6/1989 | Bosshard | 206/222 |

*Primary Examiner*—Bryon P. Gehman
*Attorney, Agent, or Firm*—Leon Gilden

[57] ABSTRACT

A sanitary disposable container is set forth wherein the container is formed with a rigid floor with orthogonally and upwardly extending accordion walls wherein the container is extensible to accommodate a predetermined volume of refuse and may be compactly stored when not in use. A reciprocatably slidable lid is mounted to an upper perimeter of the container wherein the lid is provided with a securement strap and further provided with a deodorizing agent formed internally of the lid to be directed into the refuse when the container is utilized.

3 Claims, 1 Drawing Sheet

SANITARY DISPOSABLE CONTAINER

BACKGROUND OF THE INVENTION

1. Field of the Invention

The field of invention relates to refuse containers, and more particularly pertains to a new and improved sanitary disposable container wherein the same may be compactly stored when not in use and may be readily extended for use when needed.

2. Description of the Prior Art

The use of refuse containers of various types is well known in the prior art. Refuse containers of the prior art, however, have heretofore failed to provide a complete system for the disposal of refuse in an economically manufactured and developed container wherein the container is not only compactly stored when not use, but provides additional securement means to enclose the container when full and to further provide a self-included sanitizing mechanism. Examples of the prior art include U.S. Pat. No. 3,399,818 to Stegner wherein a container is provided with an interior impermeable layer or liner adhesively secured interiorly of the container.

U.S. Pat. No. 3,554,434 to Anderson sets forth a free flexible package wherein two flexible plastic sheets are heat sealed to provide a tubular-like upstanding portion for containment of contents therewithin, but lacks the securement means and enclosing organization of the instant invention.

U.S. Pat. No. 3,638,385 to Goodrich sets forth a polyethylene container for securement of liquids therewithin which may be interfolded when not in use and may be expanded for containment of fluids therewithin.

U.S. Pat. No. 3,669,347 to Platz sets forth a generally plastic-type bag which may be snapped open, including self-sustaining walls to remain in an erect position when opened up to a use orientation.

U.S. Pat. No. 3,682,372 to Rodley sets forth a plastic sheet material bag foldable into a flat orientation and provided with handles for portability.

U.S. Pat. No. 3,738,565 to Ackley sets forth a free-standing bag formed of impermeable plastic material wherein similarly, U.S. Pat. No. 3,743,172 utilizes a laminated film structure for providing securement of contents therewithin in enhanced strength organization. Similarly, U.S. Pat. No. 4,491,959 to Loefberg utilizes a gusseted plastic bag typical in geometric configuration of bag-like structures available in the prior art.

As such, it may be appreciated that there is a continuing need for a new and improved sanitary disposable container wherein the same addresses both the problems of ease of storage and effectiveness in use, and as such, the present invention substantially fulfills this need.

SUMMARY OF THE INVENTION

In view of the foregoing disadvantages inherent in the known types of refuse containers now present in the prior art, the present invention provides a sanitary disposable container wherein the same may be compactly stored when not in use and may be further easily and effectively extended for use by an individual. As such, the general purpose of the present invention, which will be described subsequently in greater detail, is to provide a new and improved sanitary disposable container which has all the advantages of the prior art refuse containers and none of the disadvantages.

To attain this, the present invention comprises a refuse container of generally rectangular cross-sectional configuration provided with a rigid floor and accordion walls wherein the bag may be compactly interfolded for storage when not in use. The walls of the container include an upwardly extending rigid rim with sides of the rim of a generally S-shaped configuration to complementarily receive a rigid lid slidably thereover for containment of refuse therewithin. The lid is provided with a snap fastener securable to a forwardmost portion of the rim and is further provided with a sanitizing agent including a plunger formed with a sharpened end extending interiorly through a bottom face of the lid and extending into a flexible membrane. The flexible membrane contains a deodorizing agent that upon impact of the button directs the deodorizing agent onto the contents contained within the refuse container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sanitary disposable container which has all the advantages of the prior art refuse containers and none of the disadvantages.

It is another object of the present invention to provide a new and improved sanitary disposable container which may be easily and efficiently manufactured and marketed.

It is a further object of the present invention to provide a new and improved sanitary disposable container which is of a durable and reliable construction.

An even further object of the present invention is to provide a new and improved sanitary disposable container which is susceptible of a low cost of manufacture with regard to both materials and labor, and which accordingly is then susceptible of low prices of sale to the consuming public, thereby making such sanitary disposable containers economically available to the buying public.

Still yet another object of the present invention is to provide a new and improved sanitary disposable container which provides in the apparatuses and methods of the prior art some of the advantages thereof, while simultaneously overcoming some of the disadvantages normally associated therewith.

Still another object of the present invention is to provide a new and improved sanitary disposable container wherein the same may be readily stored during periods of non-use and is further provided with securement and sanitizing means discouraging offensive odors and undesirable destruction of the container by animals and the like, also to self deteriate in landfill sites.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
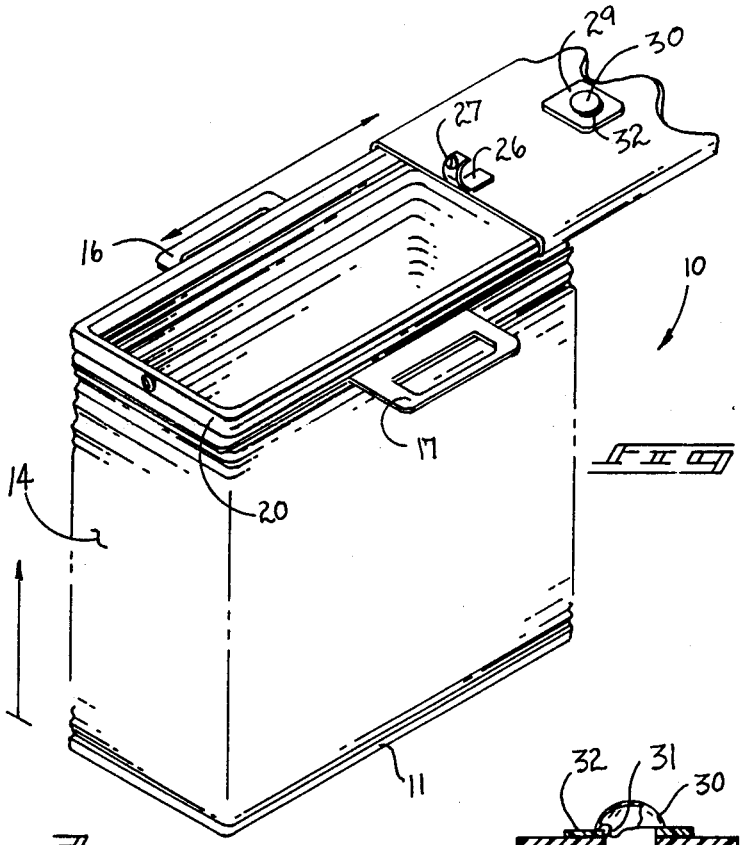
FIG. 1 is an isometric illustration of the instant invention in an extended orientation.
Figure 2:
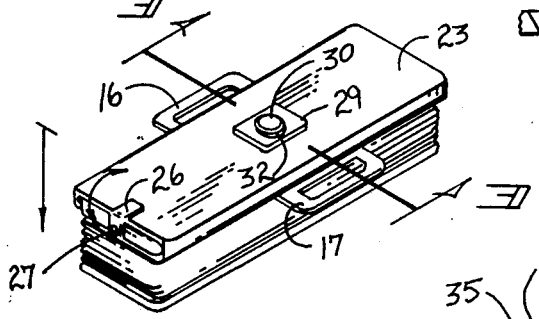
FIG. 2 is an isometric illustration of the instant invention in a retracted compact configuration.
Figure 4:
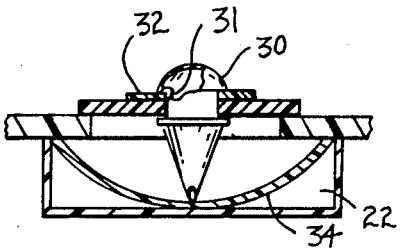
FIG. 4 is an orthographic cross-sectional view, somewhat expanded, of the plunger organization of the instant invention.
Figure 3:
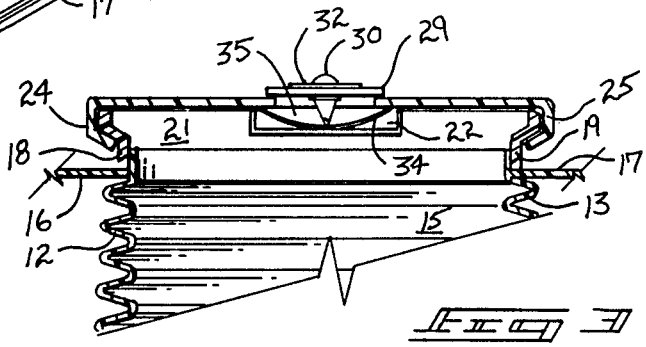
FIG. 3 is an orthographic view taken along the lines 3—3 of FIG. 2 in the direction indicated by the arrows.

With reference now to the drawings, and in particular to FIGS. 1 to 4 thereof, a new and improved sanitary disposable container embodying the principles and concepts of the present invention and generally designated by the reference numeral 10 will be described.

More specifically, it will be noted that the sanitary disposable container 10 essentially comprises a container formed with a planar rigid floor 11 including a left accordion wall 12, a right accordion wall 13 disposed generally parallel to the left accordion wall with spaced forward and rear accordion end walls 14 and 15 to provide a container body of a generally rectangular cross-sectional configuration. The respective left and right side walls 12 and 13 have integrally secured at upper terminal ends thereof respective left and right flexible handles 16 and 17 formed with central openings of a length substantially equal to the width of each respective forward and rear end wall to enable the handles to overlie the top lid of the organization for transport of a container, as desired. Spaced adjacent to and extending upwardly from the left and right handle 16 and 17 are left and right integral S-shaped ribs 18 and 19 coextensive with each upper edge of the side walls and integrally formed to a forward flange 20 and a rear flange 21 to provide an encircling perimeter rim of the container. The forward and rear flanges 20 and 21 respectively are generally planar and coextensive with the forward and rear end walls 14 and 15. The rear flange 21 is formed with a slot 22 medially thereof at an upper edge of the rear flange, to accommodate a rearward sliding of the planar lid 23 and an underlying membrane 34, to be discussed in more detail below.

A planar lid 23 is provided with downwardly depending sides with a U-shaped left side 24 extending interiorly of the lid with confronting relationship to a right U-shaped side 25. The U-shaped sides are of a complementary configuration to that of the S-shaped ribs 18 and 19 respectively to slidingly enable reciprocation of the lid 23 relative to the left and right S-shaped ribs 18 and 19, as illustrated in FIG. 1 for example. A securement strap 26 is integrally formed adjacent a forward edge of the lid 23 with a first snap fastener 27 formed in a terminal free end of the strap 26 to cooperate with a second snap fastener 28 positioned and secured medially of the forward flange 20 to enable fastening and securement of the lid 23 to overlie the container's interior for securement of refuse deposited therewithin.

Positioned medially of the lid 23 is an upwardly extending boss 29. The boss 29 includes a plunger head 30 positioned medially of the boss. The plunger head 30 is provided with an encircling groove 31 receiving a frangible encircling washer 32 to overlie the boss 29. A lowermost end of the plunger head 30 is provided with a piercing point 33 positioned interiorly of a membrane 34 that is sealingly secured to a bottom surface of the lid 23 in a first position. Contained within the membrane 34 is a liquid deodorizing agent 35 whereupon application of force downwardly to the plunger head 30 directs the piercing point 33 through the membrane 34 upon destruction of the frangible washer 32 to direct the deodorizing agent 35 contained within the membrane 34 to deodorize refuse and the like contained within the container 10 to discourage destruction of the container by animals and the like when the container is unattended and to further minimize offensive odors emanating from the container when storing refuse therewithin.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An extensible and retractable sanitary disposable container comprising, a floor including a right accordion wall, a left accordion wall, a forward accordion wall, and a rear accordion wall wherein each of the walls extend upwardly and orthogonally relative to the floor, and a lid slidably mounted proximate upper terminal ends of the walls wherein the lid includes securement means for selective securement of the lid in association with the forward accordion wall, and wherein the accordion walls are integrally secured to one another and to the floor to provide a container of generally rectangular cross-sectional configuration, and wherein the floor comprises a rigid planar floor, and wherein an S-shaped rib is secured to an upper terminal edge of the left accordion wall and further including a right S-shaped rib integrally secured to an upper edge of the right accordion wall, and a forward flange secured to the upper terminal end of the forward accordion wall, and a rear flange secured to an upper terminal edge of the rear wall, wherein the forward and rear flanges are generally planar and wherein the forward and rear flanges respectively are secured to the left and right S-shaped ribs to provide a continuous upper perimeter rigid member, and wherein the lid includes a U-shaped left side extending downwardly from an upper surface of the lid and further including a U-shaped right side extending downwardly from the lid spaced from the left side and wherein the U-shaped left and right sides are of a complementary configuration to sidably receive the respective left and right S-shaped ribs, and wherein the rear flange includes a slot, and wherein the lid includes a flexible membrane sealingly secured to a bottom surface of the lid and further including a plunger head extending through the lid with the plunger head including a lowermost end provided with a piercing point spaced above the membrane in a first position, and an upper end of the plunger head including an encircling groove including a frangible encircling washer positioned within the groove wherein the frangible encircling washer is broken upon downwardly directing the plunger interiorly of the lid to pierce the membrane in a second lowered position of the plunger.

2. An extensible and retractable sanitary disposable container as set forth in claim 1 further including a first handle secured coextensively with an uppermost end of the left accordion side wall and a second handle formed coextensively with an uppermost end of the right accordion side wall.

3. An extensible and retractable sanitary disposable container as set forth in claim 2 wherein each handle is of a length substantially equal to a width defined by the forward or rear accordion end wall to enable the handles to overlie the lid for transport of the container.

* * * * *